US006357250B1

(12) United States Patent
Paxman

(10) Patent No.: US 6,357,250 B1
(45) Date of Patent: Mar. 19, 2002

(54) TRIM COOLER

(76) Inventor: Neil Eric Paxman, 5 Hayfield Close, Scholes, Huddersfield, HD17 1XQ (GB)

( * ) Notice: Subject to any disclaimer, the term of this patent is extended or adjusted under 35 U.S.C. 154(b) by 0 days.

(21) Appl. No.: 09/553,727

(22) Filed: Apr. 20, 2000

(30) Foreign Application Priority Data

Apr. 22, 1999 (GB) ..... 9909216

(51) Int. Cl.[7] ..... B67D 5/62

(52) U.S. Cl. ..... 62/389; 62/393; 62/396; 62/434

(58) Field of Search ..... 62/393, 396, 434, 62/389

(56) References Cited

U.S. PATENT DOCUMENTS 3,998,070 A * 12/1976 Mueller ..... 62/393
4,730,463 A * 3/1988 Stanfill ..... 62/399
4,860,923 A * 8/1989 Kirschner et al. ..... 222/1
4,916,910 A * 4/1990 Schroeder ..... 62/59
5,079,927 A * 1/1992 Rodino et al. ..... 62/99
5,140,832 A * 8/1992 Deininger et al. ..... 62/389
5,280,711 A * 1/1994 Motta et al. ..... 62/177
5,535,600 A * 7/1996 Mills ..... 62/390
5,715,700 A * 2/1998 Credle, Jr. ..... 62/390
5,873,259 A * 2/1999 Spillman ..... 62/396
5,987,900 A * 11/1999 Love ..... 62/66

* cited by examiner

*Primary Examiner*—William Doerrler
*Assistant Examiner*—Mark S. Shulman
(74) *Attorney, Agent, or Firm*—Oppenheimer Wolff & Donnelly, LLP

(57) ABSTRACT

A trim cooler for cooling a drink in a drinks line, the trim cooler comprising a refrigerator comprising an evaporator, a condenser and a compressor for circulating a cooling medium therebetween to cool the evaporator;

the evaporator being in thermal contact with the drinks line;

a coolant line in thermal contact with the condenser; and, a coolant source connected to the coolant line and adapted to supply a liquid coolant to the coolant line.

10 Claims, 6 Drawing Sheets

TRIM COOLER

The present invention relates to a trim cooler for cooling a drink in a drinks line and is concerned particularly, but not exclusively, with a trim cooler for cooling a drink immediately prior to serving.

It has become common practice in bars and restaurants to serve soft drinks and lagers chilled, rather than at room temperature. Such drinks are usually kept at room temperature in a cellar or other location remote from the bar and are only chilled immediately before serving. The drinks containers are connected to dispensers at the bar by drinks lines These drinks lines are wound around "python" lines which contain chilled water typically maintained at a temperature of the order 36F. As the drink passes along the drinks line from the container to the dispenser it is cooled by the adjacent python line and so arrives at the dispenser at the correct temperature. Such a system is suitable for serving drinks at temperatures of the order 5C and above.

If one wishes to serve drinks at lower temperatures then it is necessary to include a trim cooler close to the dispenser and in thermal contact with the drinks line (typically under the bar). The trim cooler receives the cooled drink from the drinks line at a temperature of the order five degrees centigrade and cools it by a further three to four centigrade.

Known trim coolers are air cooled and include fans which draw air across the condenser of the trim cooler refrigeration unit. Air cooling is relatively inefficient and large fans are required. Such fans considerably increase the size of the trim cooler unit, use a large amount of power and also generate unwanted heat.

Accordingly, the present invention provides a trim cooler for cooling a drink in a drinks line the trim cooler comprising a refrigerator comprising an evaporator, a condenser and a compressor for circulating a cooling medium therebetween to cool the evaporator;

the evaporator being in thermal contact with the drinks line;

a coolant line in thermal contact with the condenser; and, a coolant source connected to the coolant line and adapted to supply a liquid coolant to the coolant line.

Such a liquid cooled trim cooler does not require a fan to cool the condenser. It is therefore relatively small and so can be positioned under a bar without any significant loss of storage space. It also does not generate unwanted heat. A large number of such trim coolers can be installed below a bar without any unwanted increase in temperature in the surrounding room.

Preferably, the liquid coolant is at a temperature of less than the surrounding room temperature. By using such a chilled coolant one can increase the efficiency of the trim cooler so reducing the amount of unwanted heat generated by the cooler during use.

Preferably the liquid coolant is water.

The coolant source can be a python line adapted to supply cooled water at constant temperature. The water in the python line can therefore be used twice, once to coal the drink as the drink travels along the drinks line from the cellar to the trim cooler and then again to cool the condenser of the trim cooler. This efficient use of cooling water reduces the cost of chilling drinks to the required temperature. In addition, because the python line supplies water of a constant temperature the condenser s always maintained at a fixed temperature. The refrigeration unit can be optimised to work with a condenser at this fixed temperature. Known air cooled trim coolers mast be able to operate when being cooled by air of an unknown and variable air temperature. The trim cooler of the invention is typically two to three times more efficient than known air cooled trim coolers.

Preferably, a portion of the coolant line comprises a heat exchange tank through which the liquid coolant flows in use, a portion of the condenser being located within the heat exchange tank and being in thermal contact with the liquid coolant. This provides a simple and effective method of cooling the cooling medium in the condenser.

Alternatively, the trim cooler according to the invention further comprises a heat exchange tank, a portion of the condenser and a portion of the coolant line being located within the heat exchange tank, the condenser portion and coolant line portion being in thermal contact.

Preferably, the heat exchange tank comprises a heat exchange medium. The heat exchange medium ensures an efficient transfer of heat form the condenser to the coolant line. Preferably, the trim cooler further comprises a pump for circulating the heat exchange medium through the exchange tank. This prevents the formation of localised cold spots on the condenser.

Preferably, at least one of a portion of the coolant line and a portion of the condenser comprises a coil within the heat exchange tank. Coils increase the length of coolant line or condenser which can be arranged within the heat exchange tank so ensuring an efficient heat transfer.

The coolant line coil and the condenser coil can be coaxial.

The present invention will now be described by way of example only, and not in any limitative sense, with reference to the drawings, in which.

Figure 1:
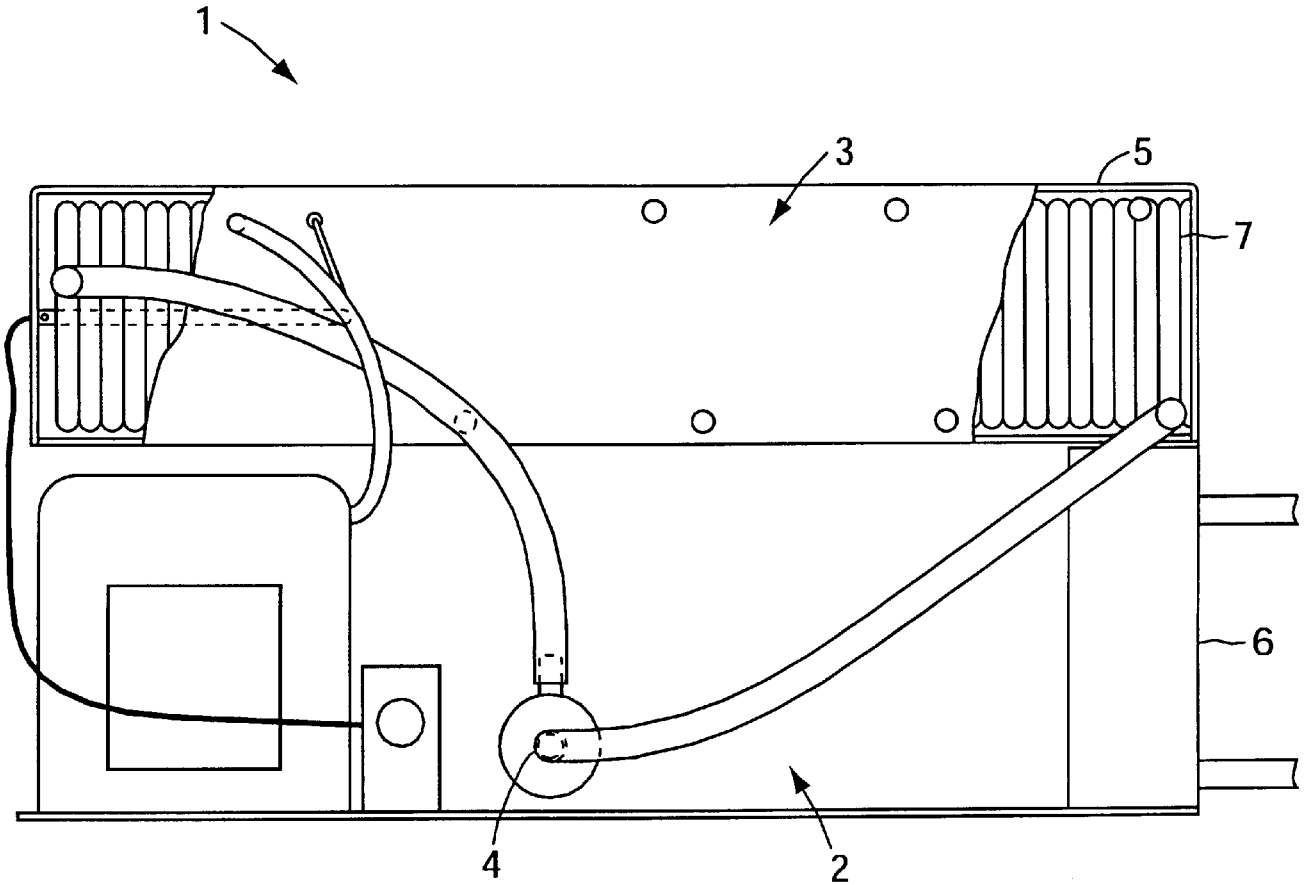
FIG. 1 shows a plan view of a known trim cooler.

Shown in FIG. 1 is a plan view of a known trim cooler 1. The trim cooler comprises a refrigerator 2 which in turn comprises an evaporator 3, a condenser (not shown) and a compressor 4 The compressor 4 circulates a cooling medium (typically R134A) between the evaporator 3 and the condenser (not shown), resulting in the cooling of the evaporator 3. The operation of such a refrigerator 2 is well known.

The trim cooler 1 comprises an evaporator tank 5 located on a cabinet 6. Arranged within the evaporator tank 5 is the evaporator 3 shaped as a coil 7 through which the chilled cooling medium flows. Also located within the evaporator tank 5 is a drinks coil (not shown) through which drink flows in use. The drinks coil and the evaporator coil 7 are made from materials of high thermal conductivity such as copper or stainless steel. The evaporator tank 5 is filled with a heat exchange medium 8 which ensures a good thermal contact between the drinks coil and the evaporator coil 7.

In use drink flows from a drinks barrel, along a drinks line, where it is cooled by an adjacent 'python' line. The drink then passes through the drink coil portion of the drinks line located within the evaporator tank 5 and then to a dispenser where it is served. Simultaneously the compressor 4 circulates the cooling medium between the evaporator coil 7 and the condenser, so cooling the evaporator. As the evaporator coil 7 is cooler than the drinks coil heat flows from the drinks coil through the heat exchange medium 8 to the evaporator coil 7. This cools the drink to the required serving temperature whilst simultaneously warming the cooling medium.

After leaving the evaporator coil 7 the warm cooling medium is compressed by the compressor 4. From the compressor 4 the cooling medium is transferred to the condenser where it is cooled before being recirculated to the evaporator 7. It is therefore necessary to continually cool the condenser during use. In such a known trim cooler 1 air is drawn over the condenser by a fan in order to cool it. Such known air cooled trim coolers 1 are relatively inefficient, bulky arid generate a large amount of heat.

Figure 2:
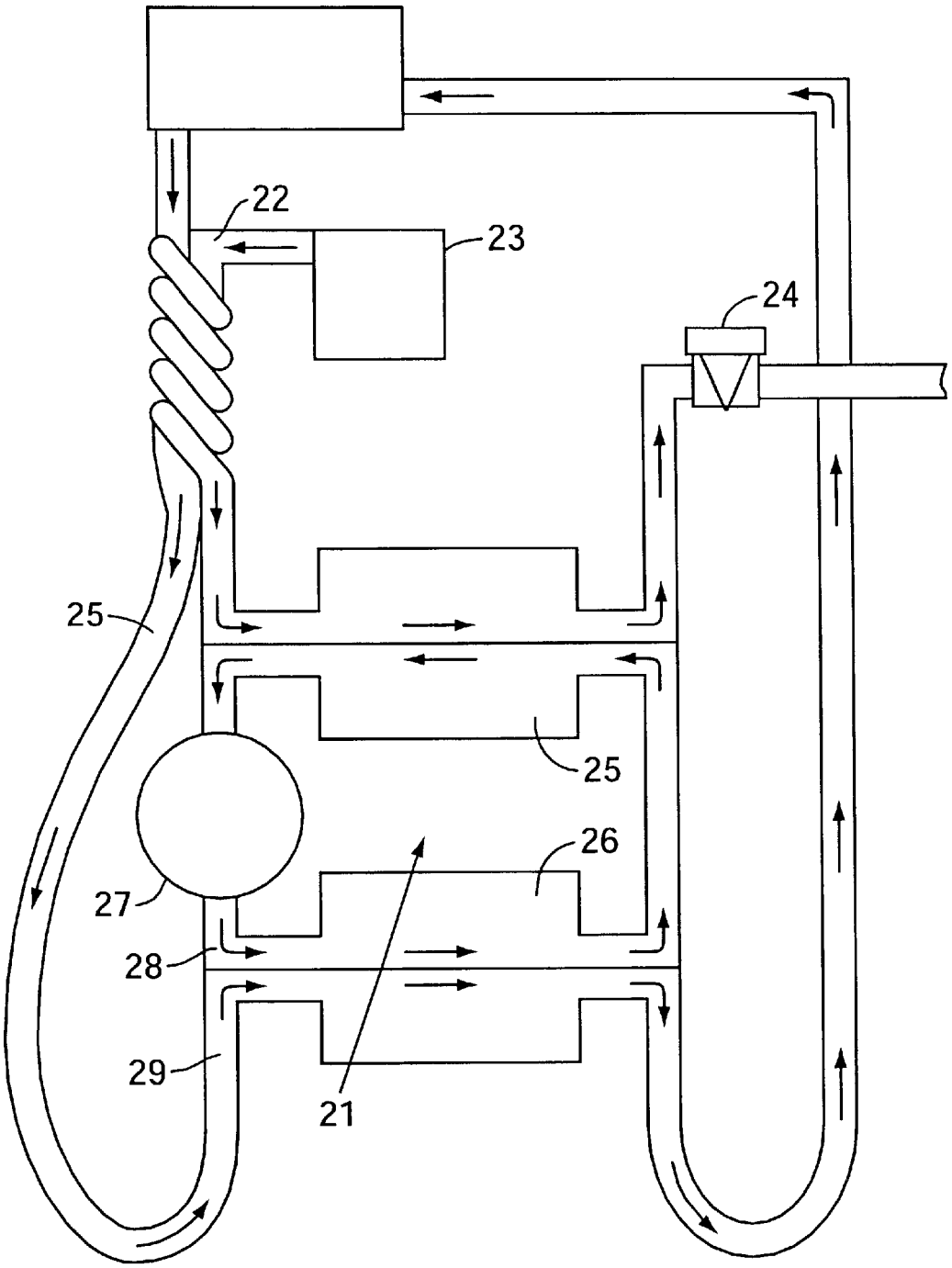
FIG. 2 shows a plan schematic view of a trim cooler according to the invention and associated components.

Shown in FIG. 2 is a schematic view of a trim cooler 21 according to the invention in thermal contact with a drinks line 22. The drinks line 22 is connected between a barrel 23 containing drink at room temperature and a dispenser 24. The drinks line 22 is wrapped around a python line 25 which contains chilled water. When a tap of the disperser 24 is opened the drink travels from the barrel 23, along the drinks line 22 towards the dispenser 24. As the drink travels along the drinks line 22 it is cooled by contact with the python line 25. Located before the dispenser 24 is the trim cooler 21. When the drink reaches the trim cooler 21 it is colder than room temperature but is typically 3–4° C. warmer than the desired serving temperature. The drink is cooled further to the desired temperature by the trim cooler 21 and finally served.

As with known trim coolers 1, the trim cooler 21 according to the invention comprises an evaporator 25, a condenser 26 and a compressor 27. The compressor is for circulating a cooling medium 28 between the evaporator 25 and condenser 26 so cooling the evaporator 25. The drinks line 22 is in thermal contact with the evaporator 25, resulting in the cooling of the drink with the drinks line 22.

Rather than being air cooled, the condenser 26 of the trim cooler 21 according to the invention is cooled by thermal contact with a coolant line 29. The coolant line 29 is connected to a coolant source 30 which is adapted to supply a liquid coolant to the coolant line 29. In the present embodiment of the invention the coolant line 29 is connected to the python line 25 so receiving chilled water at a uniform temperature. In an alternative embodiment the coolant line 29 is connected to a separate source 30 of liquid coolant. Liquid coolant reduces the temperature of the condenser 26 to an optimum working temperature. Use of liquid coolant in this way removes the need for a fan so considerably reducing the size of the trim cooler 21 and also the amount of heat generated.

The temperature of the cooling water from the python line 25 remains substantially uniform throughout the day. The design of the trim cooler 21 can therefore be optimised to work with the condenser 26 at a fixed known temperature. The trim cooler 21 of the invention is typically 2–3 times more efficient than trim coolers which work when being cooled by air of a temperature which varies throughout the day.

Figure 3:
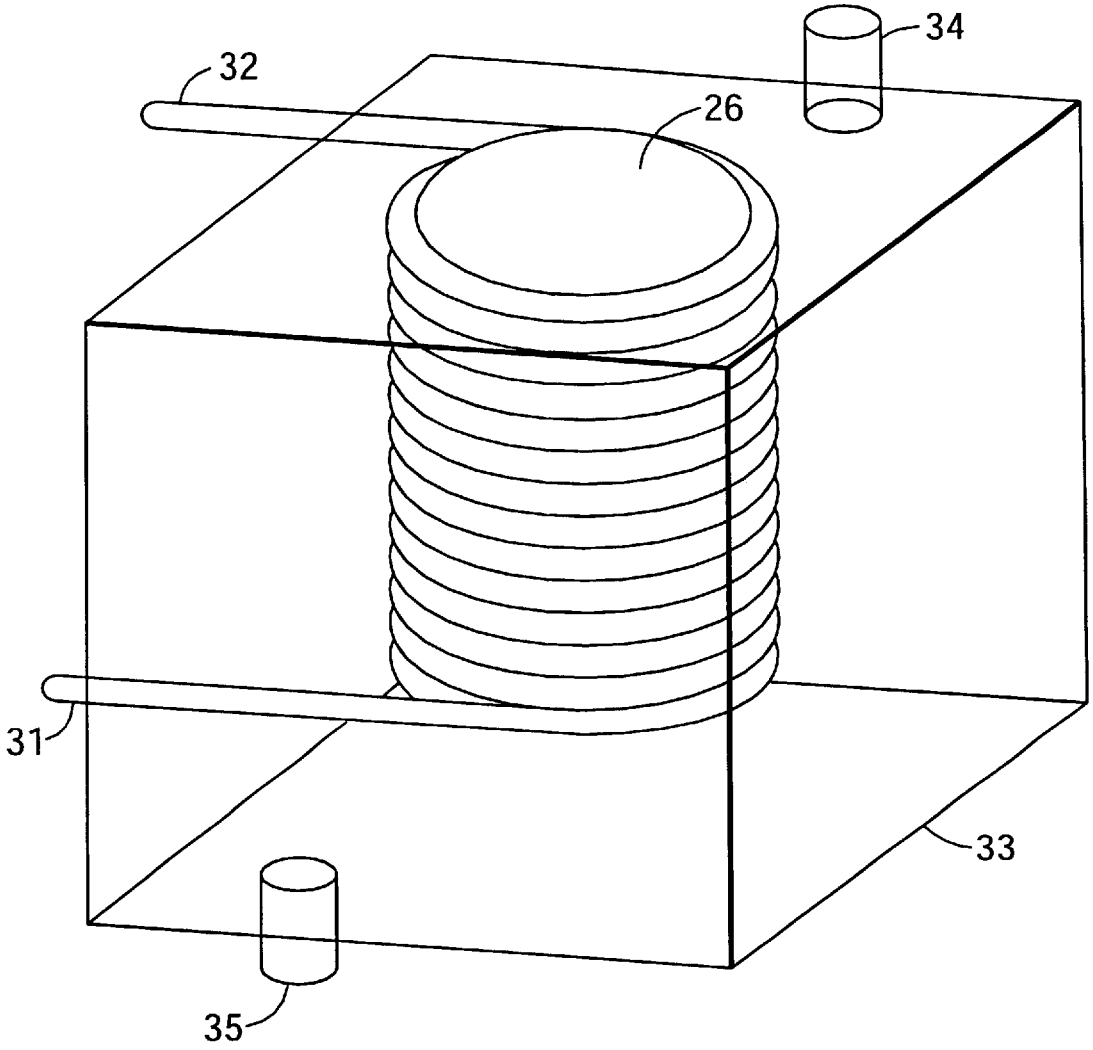
FIG. 3 shows a perspective view of a condenser of a trim cooler according to the invention.

Shown in FIG. 3 is a condenser 26 of a trim cooler 21 according to the invention. The condenser 26 is formed as a coil having a high thermal conductivity. The cooling medium 28 which has been warmed by its passage through the evaporator 25 enters into the condenser 26 via entrance port 31, flows through the condenser coil 26, and exits at exit port 32 and then returns to the evaporator 25. The condenser is arranged within a heat exchange tank 33. Chilled water from the python line 25 flows into the coolant line 29, enters the heat exchange tank 33 at entrance port 34, flows through the heat exchange tank 33 and then exits at exit port 35. The condenser 26 is typically made of a material of high thermal conductivity such as copper stainless steel or aluminium. This ensures efficient cooling of the cooling medium 28 by the chilled water in the heat exchange tank 33 as it passes through the condenser 26.

Figure 4:
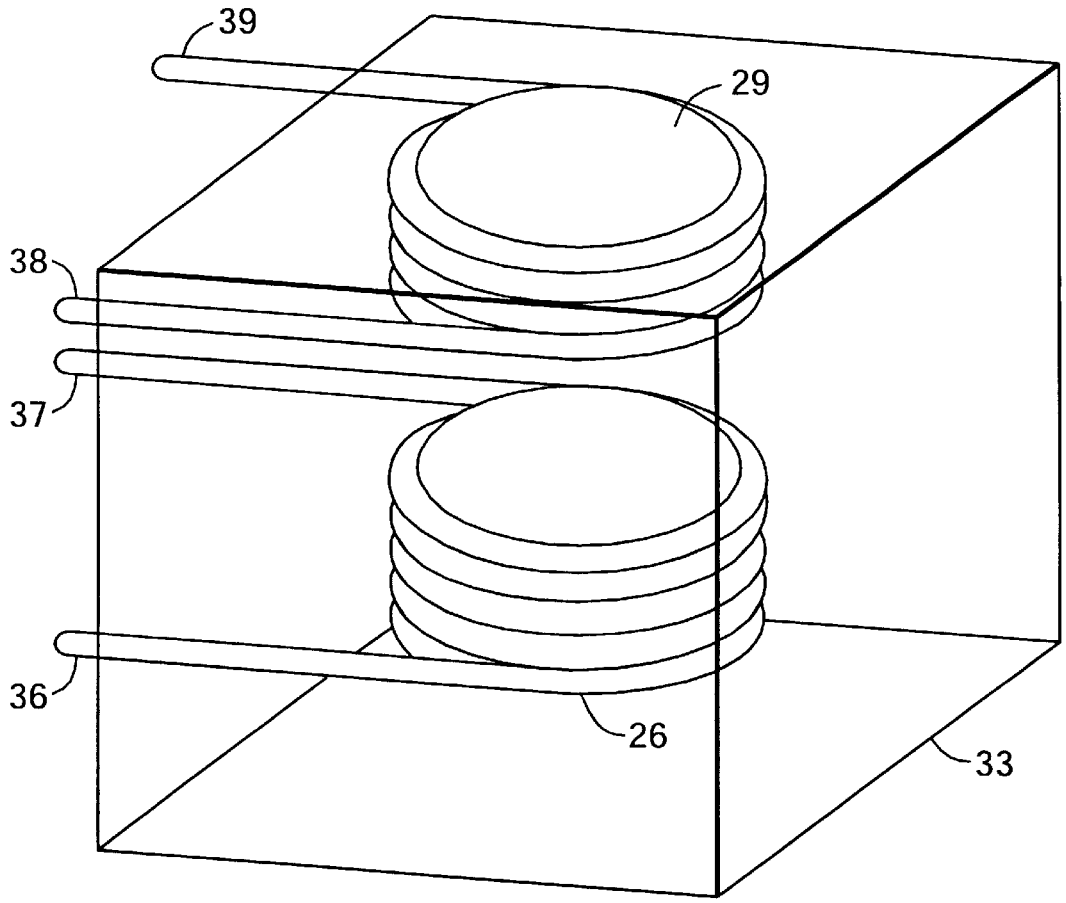
FIG. 4 shows a perspective view of a condenser of a further embodiment of the trim cooler according to the invention.

Shown in FIG. 4 is a further embodiment of a condenser 26 of a trim cooler 21 according to the invention. The condenser 26 is located within a heat exchange tank 33 and is shaped as a hollow coil. The cooling medium 28 enters and exits the condenser coil 26 by entrance port 36 and exit port 37. Also located within the heat exchange tank 33 is a portion of the coolant line 29 formed as a hollow coil co-axial with the condenser 26. Cooling water enters the coolant line 29 via water entrance port 36 and exits via water exit port 39. Both coils 26, 29 are immersed in a heat exchange medium ensuring good thermal contact between the condenser coil 26 and the coolant line 29.

Figure 5:
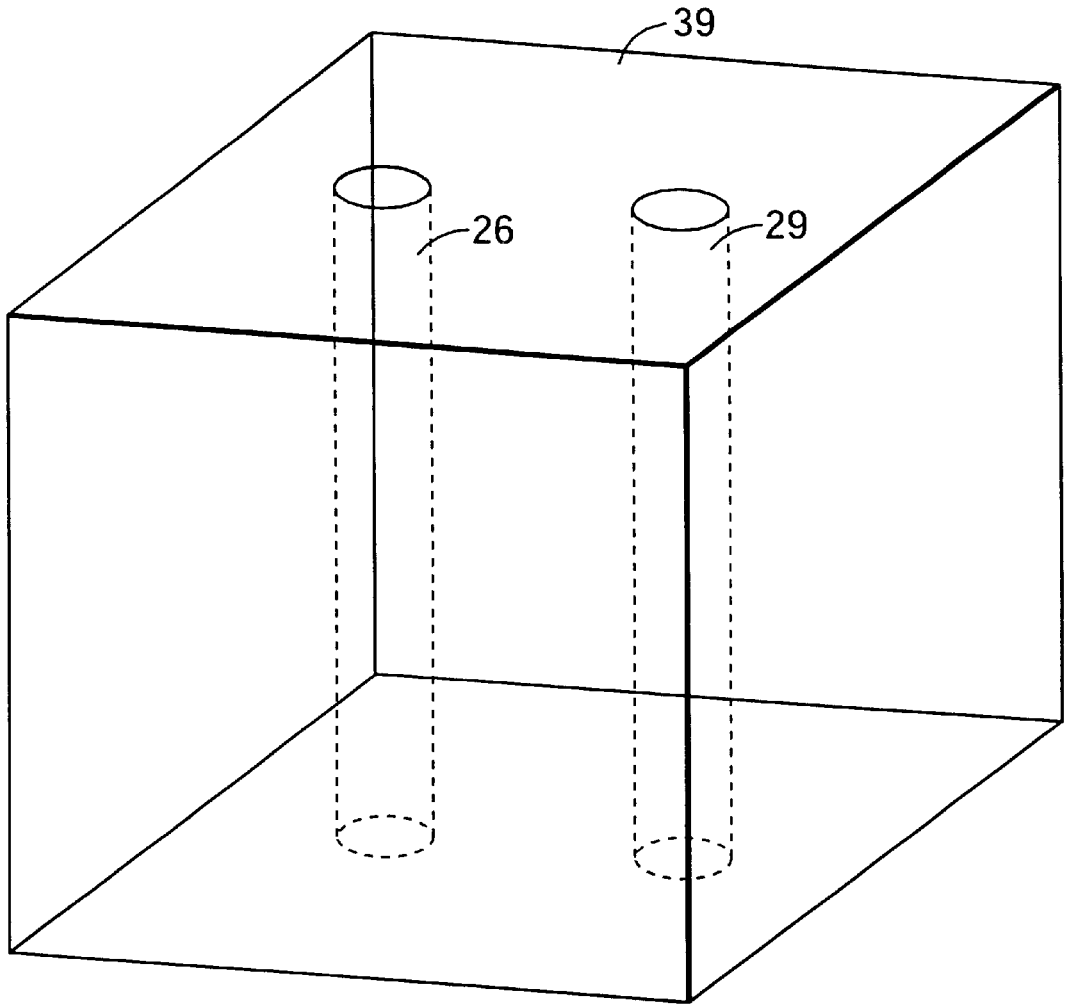
FIG. 5 shows a perspective view of a condenser of a further embodiment of a trim cooler according to the invention.

Shown in FIG. 5 is a further embodiment of a condenser 26 of a trim cooler 21 according to the invention. The condenser 26 comprises a hollow tube which extends through a solid block 39 of a high thermal conductivity material. In this embodiment the high thermal conductivity material is a metal. Also extending through the solid block 39 is a coolant line 29 through which chilled water from the python line 25 flows. As the solid block 39 is a good thermal conductor the condenser 26 and coolant line 29 are in good thermal contact.

Figure 6:
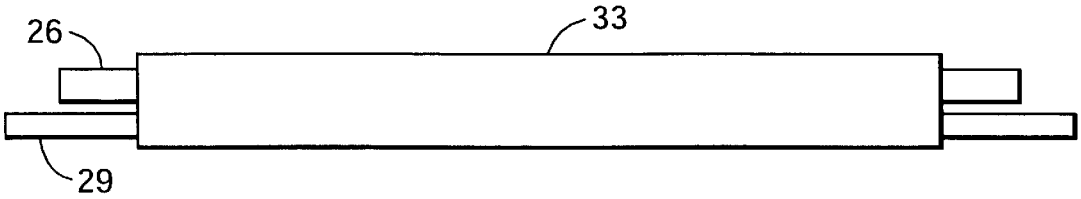
FIG. 6 shows a condenser of a further embodiment of a trim cooler according to the invention, and, FIG. 7 shows an evaporator of a further embodiment of a trim cooler according to the invention.

Shown in FIG. 6 is a further embodiment of a condenser 26 of a trim cooler 21 according to the invention. Surrounding the condenser 26 is a tubular heat exchange tank 33. Extending through the heat exchange tank 33 parallel to the condenser 26 is a coolant line 29 through which chilled water from the python line 25 flows. The coolant line 29 is in good thermal contact with the condenser 25 ensuring efficient cooling of the cooling medium 2a as it flows through the condenser 26. The heat exchange tank 33 is shown as lying in a single plane. In an alternative embodiment it is coiled.

Figure 7:
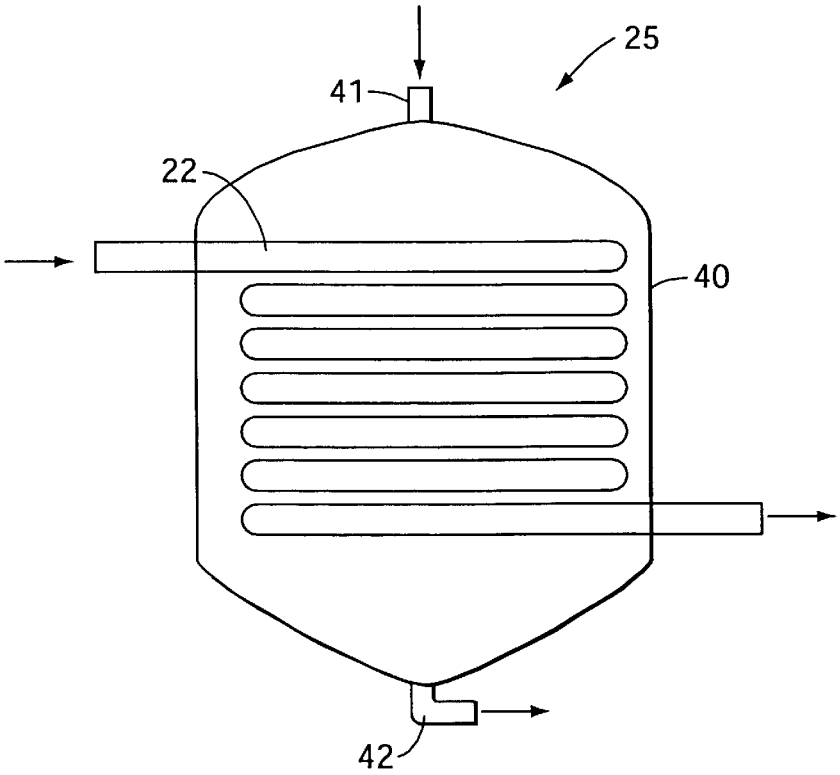

Shown in FIG. 7 is an evaporator 25 of a trim cooler 21 according to the invention. The evaporator 25 can be used in combination with any of the embodiments of the condenser 26 as previously described. The evaporator 25 comprises an evaporation tank 40 having an entrance port 41 and an exit port 42. The entrance port 41 receives cooling medium 26 which has previously been chilled by the condenser 26. The cooling medium 28 then flows through the evaporation tank 40 to the exit port 42. Located within the evaporation tank 40 is a drinks line 22. The drinks line 22 is made from a material of high thermal conductivity and is in thermal contact with the cooling medium 28 which flows through the evaporation tank. As drink flows through this portion of the drinks line 22 through the evaporation tank 40 it is chilled by the cooling medium 28 to the required temperature. Simultaneously the cooling medium 28 is warmed by the drink as previously described.

A further embodiment of an evaporator of a trim cooler according to the invention (not shown) is arranged as a coil positioned within an evaporation tank. The evaporation tank is filled with a heat exchange medium such as a water/glycol mixture or a refrigerant such as R134A. Also located within the evaporation tank is a portion of the drinks line. The heat exchange medium ensures that the drinks line and the evaporator are in good thermal contact. As the drink flows through the drinks line within the evaporation tank it is cooled by the cooling medium in the evaporator.

In a further embodiment of a trim cooler according to the invention the evaporation tank comprises a solid metal block through which the drinks line and the evaporator coil extend.

What is claimed is:

1. A trim cooler for cooling a drink in a drinks line, the trim cooler comprising a refrigerator comprising an evaporator, a condenser and a compressor for circulating a cooling medium therebetween to cool the evaporator;

the evaporator being in thermal contact with the drinks line;

a coolant line in thermal contact with the condenser; and, a coolant source connected to the coolant line and adapted to supply a liquid coolant to the coolant line.

2. A trim cooler as claimed in claim 1, wherein the liquid coolant is at a temperature of less than the surrounding room temperature.

3. A trim cooler as claimed in claim 1, wherein the liquid coolant is water.

4. A trim cooler as claimed in claim 3, wherein the coolant source is a python line adapted to supply cooled water at a constant temperature.

5. A trim cooler as claimed in claim 1, wherein a portion of the coolant line comprises a heat exchange tank through which the liquid coolant flows in use, a portion of the condenser being located within the heat exchange tank and being in thermal contact with the liquid coolant.

6. A trim cooler as claimed n claim 1 further comprising a heat exchange tank, a portion of the condenser and a portion of the coolant line being located within the heat exchange tank, the condenser line portion and the coolant line portion being in thermal contact.

7. A trim cooler as claimed in claim 6 wherein the heat exchange tank further comprises a heat exchange medium.

8. A trim cooler as claimed in claim 7 further comprising a pump for circulating the heat exchange medium through the exchange tank.

9. A trim cooler as claimed in claims 6, wherein at least one of a portion of the coolant line and a portion of the condenser comprises a coil within the heat exchange tank.

10. A trim cooler as claimed in claim 9 comprising a coolant line coil and a condenser coil within the heat exchange tank, the coolant line coil and the condenser coil being co-axial.

* * * * *